US012605605B1

(12) United States Patent
Pacheco

(10) Patent No.: US 12,605,605 B1
(45) Date of Patent: Apr. 21, 2026

(54) TENNIS RACKET DAMPENER DEVICE WITH VARIABLE DAMPENING

(71) Applicant: David Pacheco, Round Rock, TX (US)

(72) Inventor: David Pacheco, Round Rock, TX (US)

( * ) Notice: Subject to any disclaimer, the term of this patent is extended or adjusted under 35 U.S.C. 154(b) by 328 days.

(21) Appl. No.: 18/432,191

(22) Filed: Feb. 5, 2024

(51) Int. Cl.
*A63B 60/00* (2015.01)
*A63B 51/12* (2006.01)
*A63B 60/54* (2015.01)

(52) U.S. Cl.
CPC ..... *A63B 60/54* (2015.10); *A63B 51/12* (2013.01)

(58) Field of Classification Search
CPC ... A63B 60/54; A63B 51/12; A63B 49/00–14; A63B 51/00–16
USPC ..... 473/520–557
See application file for complete search history.

(56) References Cited

U.S. PATENT DOCUMENTS 4,180,265 A * 12/1979 Staufer ..... A63B 60/54 473/522
4,512,576 A * 4/1985 Dahlgren ..... A63B 51/12 473/534
4,761,007 A * 8/1988 Boschian ..... A63B 60/54 473/522
4,828,260 A * 5/1989 Todd ..... A63B 49/03 473/521
4,909,509 A 3/1990 Boschian
4,927,143 A * 5/1990 Hillock ..... A63B 60/54 473/522
5,022,651 A * 6/1991 Barone ..... A63B 60/54 473/522
5,106,086 A 4/1992 Acosta
5,211,397 A 5/1993 Davis et al.
5,458,331 A * 10/1995 Bothwell ..... A63B 60/54 473/534
5,651,545 A * 7/1997 Nashif ..... A63B 60/54 473/520
7,335,120 B1 * 2/2008 Pittner ..... A63B 51/005 273/DIG. 26
7,517,293 B1 * 4/2009 Smith ..... A63B 49/00 273/DIG. 26
D884,808 S 5/2020 Pacheco
2006/0135296 A1 * 6/2006 Lammer ..... A63B 60/54 473/520
2007/0265120 A1 * 11/2007 Hickey ..... A63B 60/54 377/5
2007/0293357 A1 * 12/2007 Kotze ..... A63B 49/00 473/553

(Continued)

FOREIGN PATENT DOCUMENTS

CN 1700941 A * 11/2005 ..... A63B 60/54
DE 102021122420 B3 * 9/2022 ..... A63B 60/54

(Continued)

*Primary Examiner* — Kiley S Stoner
(74) *Attorney, Agent, or Firm* — Plager Schack LLP; Mark H. Plager; Naomi Mann

(57) ABSTRACT

A vibration dampener device configured to install to the stings of a racket for dampening a vibration energy of the strings, and which allows for adjustable/tunable dampening may comprise a dampening member configured to capture a first string segment and a second string segment of the racket; and a holder assembly comprising a post including post threading, a tension adjustment nut threadably engaged to the post threading, and at least one plate.

10 Claims, 6 Drawing Sheets

(56) References Cited

U.S. PATENT DOCUMENTS

| | | | | |
|---|---|---|---|---|
| 2013/0310203 | A1* | 11/2013 | Hwang | A63B 49/00 473/522 |
| 2015/0182828 | A1* | 7/2015 | McElveen, Jr. | A63B 60/54 473/522 |
| 2017/0203189 | A1* | 7/2017 | Dorrell | A63B 69/38 |
| 2017/0274257 | A1* | 9/2017 | Chae | A63B 60/54 |
| 2022/0226711 | A1* | 7/2022 | Wizemann | A63B 51/02 |

FOREIGN PATENT DOCUMENTS

| | | | | |
|---|---|---|---|---|
| EP | 0208639 | A1 * | 1/1987 | A63B 60/54 |
| FR | 2582224 | A1 * | 11/1986 | A63B 60/54 |
| KR | 100992785 | B1 * | 11/2010 | A63B 51/12 |
| SE | 430469 | B * | 11/1983 | A63B 51/12 |
| TW | I820685 | B * | 11/2023 | A63B 60/54 |
| WO | WO-0112273 | A1 * | 2/2001 | A63B 69/38 |
| WO | WO-2004058364 | A1 * | 7/2004 | A63B 71/0622 |
| WO | WO-2007144885 | A2 * | 12/2007 | A63B 60/54 |
| WO | WO-2017009699 | A1 * | 1/2017 | A63B 60/54 |
| WO | WO-2022079126 | A1 * | 4/2022 | A63B 49/02 |

* cited by examiner

TENNIS RACKET DAMPENER DEVICE WITH VARIABLE DAMPENING

BACKGROUND

The present disclosure relates generally to vibration dampening devices and systems for tennis and other types of stringed rackets.

Vibration dampening devices may be used to mute impact shock of a tennis ball against the racket strings. As such, an improved and novel vibration dampening system is desirable.

SUMMARY

According to various embodiments, disclosed is a vibration dampener device configured to install to the stings of a racket for dampening a vibration energy of the strings, and which allows for adjustable/tunable dampening. In embodiments, the device may comprise a dampening member configured to capture a first string segment and a second string segment of the racket; and a holder assembly comprising a post including post threading, a tension adjustment nut threadably engaged to the post threading, and at least one plate. In certain embodiments, the holder assembly is configured to attach the dampening member to the strings of the racket by sandwiching the dampening member between the tension adjustment nut and the plate, wherein pressure imposed on the dampening member by the holder assembly is adjustable by twisting the tension adjustment nut to move the tension adjustment nut vertically with respect to the post. As such, twisting the tension adjustment nut in a first rotational direction moves it against the dampening member to increase dampening on the strings, and twisting the tension adjustment nut in a second rotational direction opposite the first rotational moves it away from the dampening member to decrease dampening on the strings.

In certain embodiments, the dampening member may comprise a bendable body including a central section and a central hole in the central section; a first arm extending from a first side of the central section and including a first arm hole; and a second arm extending from a second side of the central section opposite the first side, and including a second arm hole, wherein the dampening member is configured to capture the first string by folding of the first arm over a first surface of the central section to capture the first string in a fold juncture between the central section and the first arm, wherein the dampening member is configured to capture the second string by folding of the second arm over a second surface of the central section opposite the first surface, to capture the first string in a fold juncture between the central section and the first arm, and wherein sandwiching the dampening member between the tension adjustment nut and the plate comprises passing the post through the first arm hole, the central hole, and the second arm hole, said first arm hole, central hole, and second arm hole being vertically aligned when the first arm and the second arm are folded over the first surface and the second surface of the central section, respectively.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

Common vibration dampening devices provide a fixed level of dampening once installed to a racket, and may thus fall short of accommodating the needs and/or preferences of many players. To address this problem, the disclosed subject matter provides a tunable dampener device 10 that allows for adjustment of the level of dampening once installed.

Figure 1:
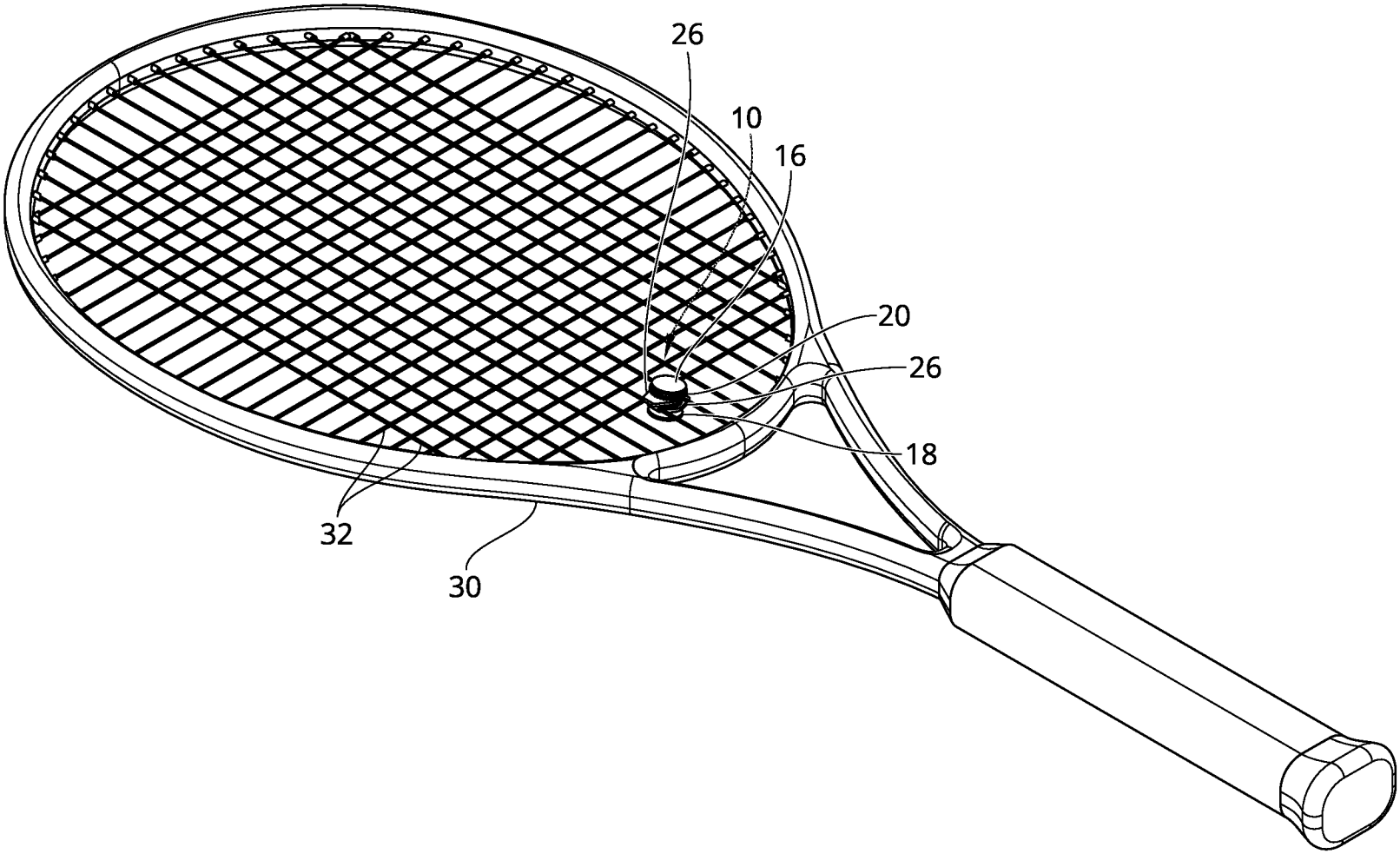
FIG. 1 is a perspective view of a tennis racket dampener device, shown installed to a tennis racket.
Figure 2:
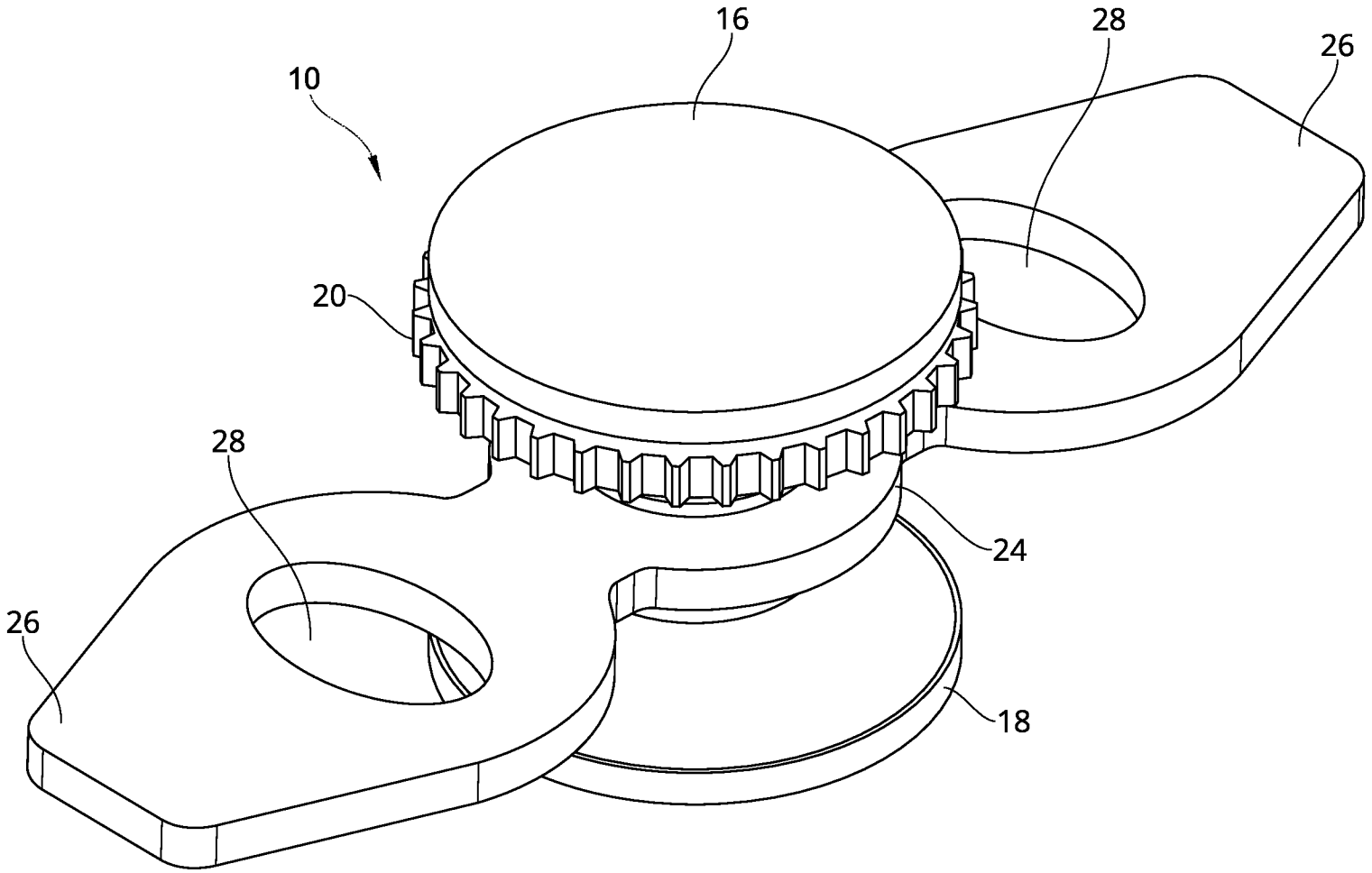
FIG. 2 is a perspective view of the dampener device.
Figure 3:
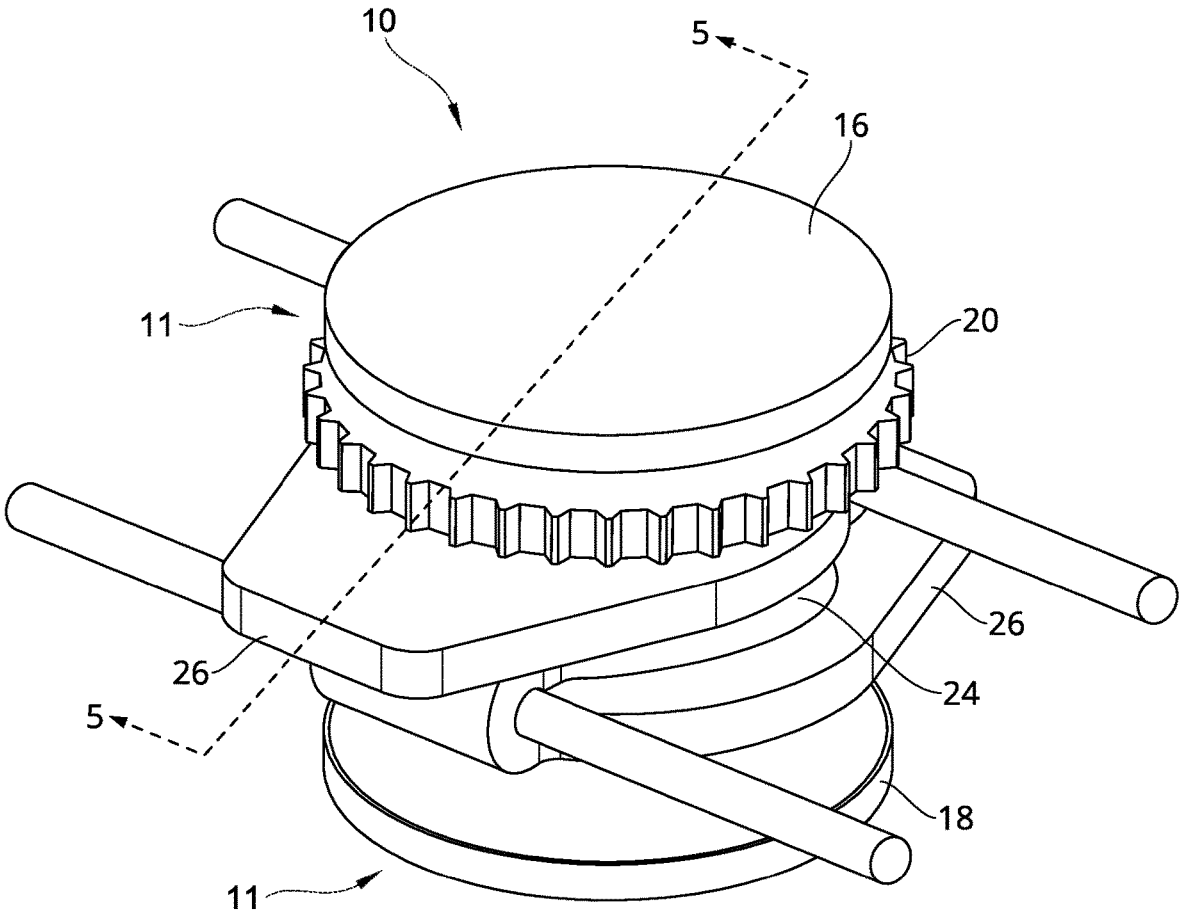
FIG. 3 is a detailed perspective view of the dampener device, shown in its installed state.
Figure 4:
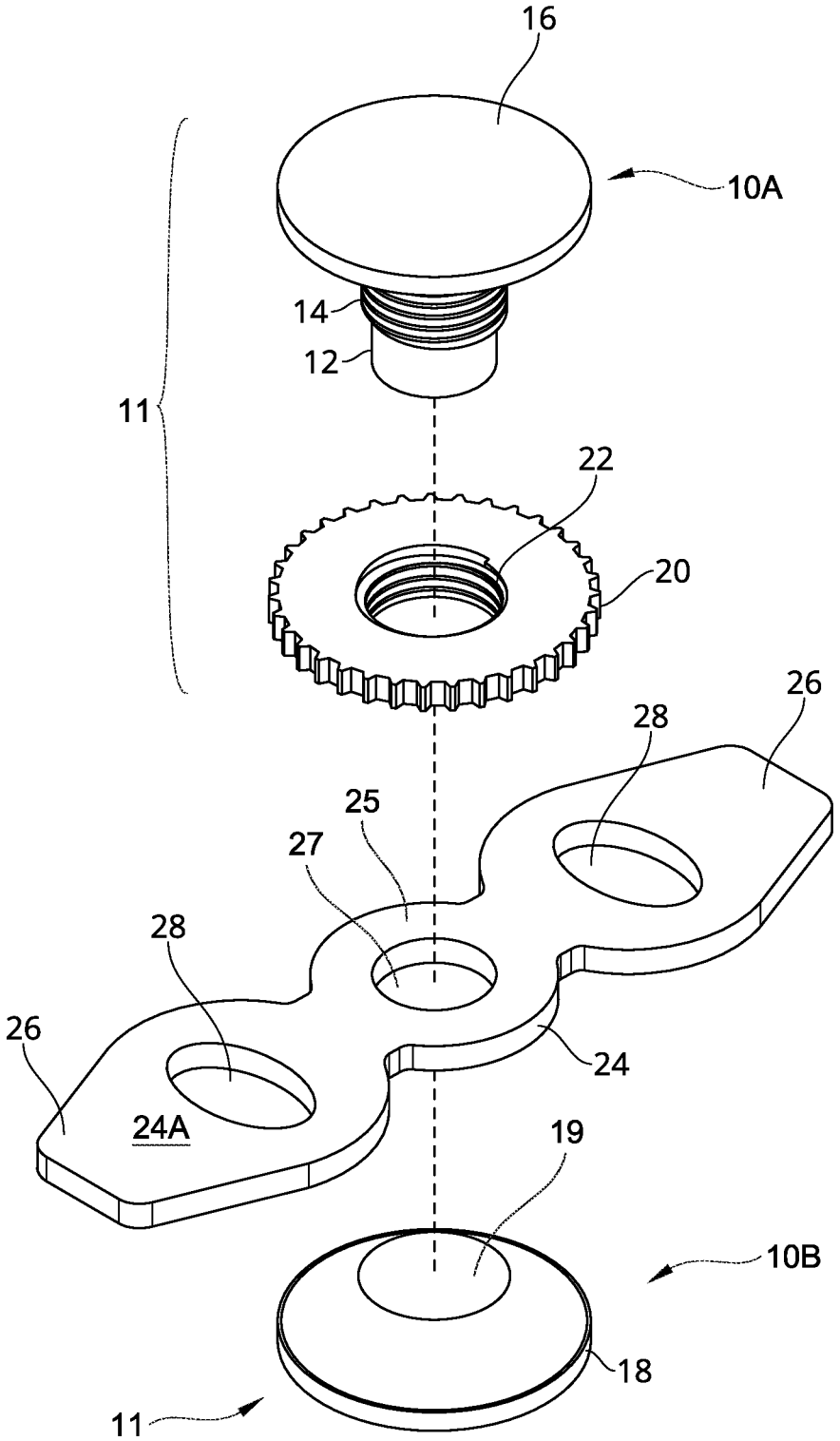
FIG. 4 is an exploded view of the dampener device.
Figure 5:
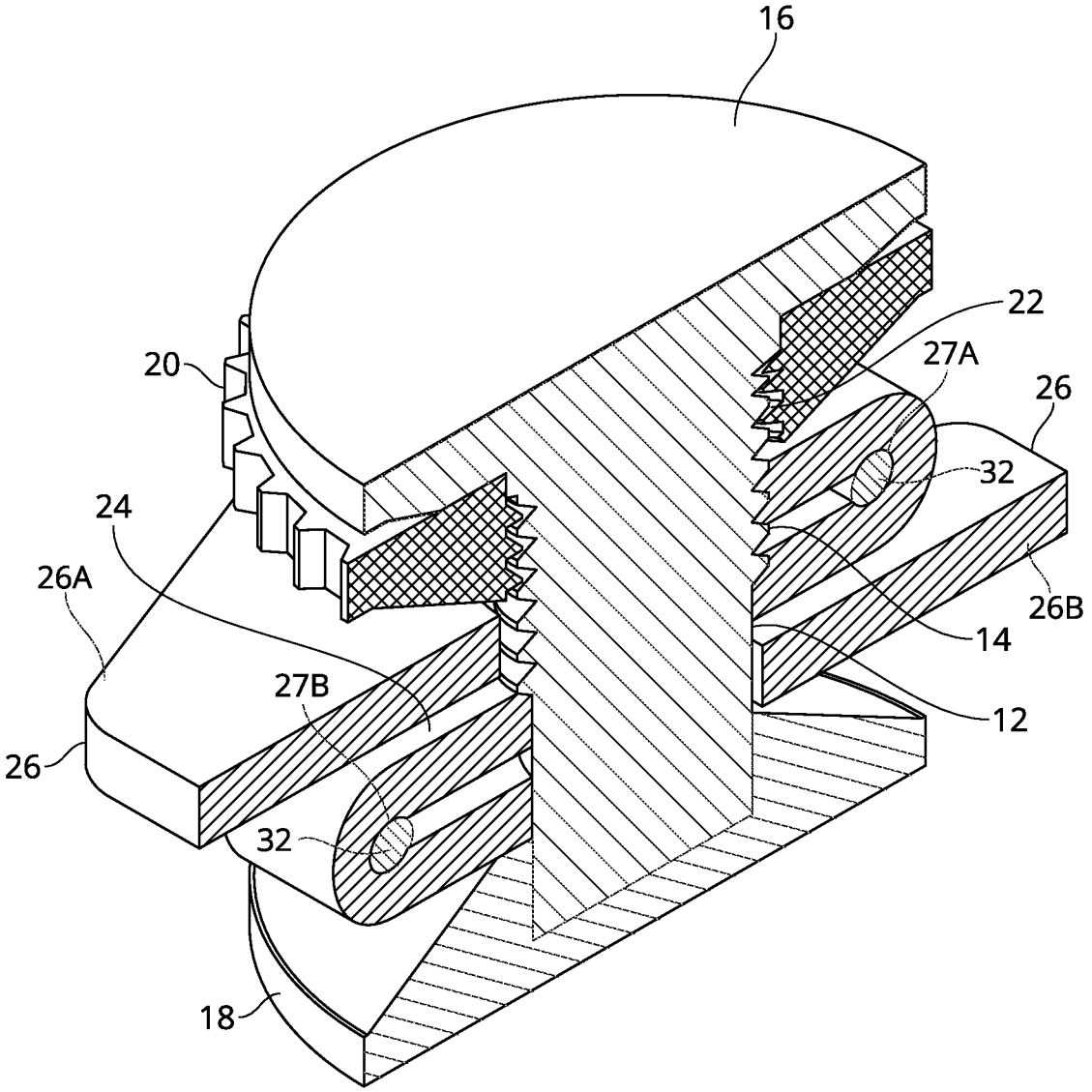
FIG. 5 is a section view taken along line 5-5 in FIG. 3.
Figure 6:
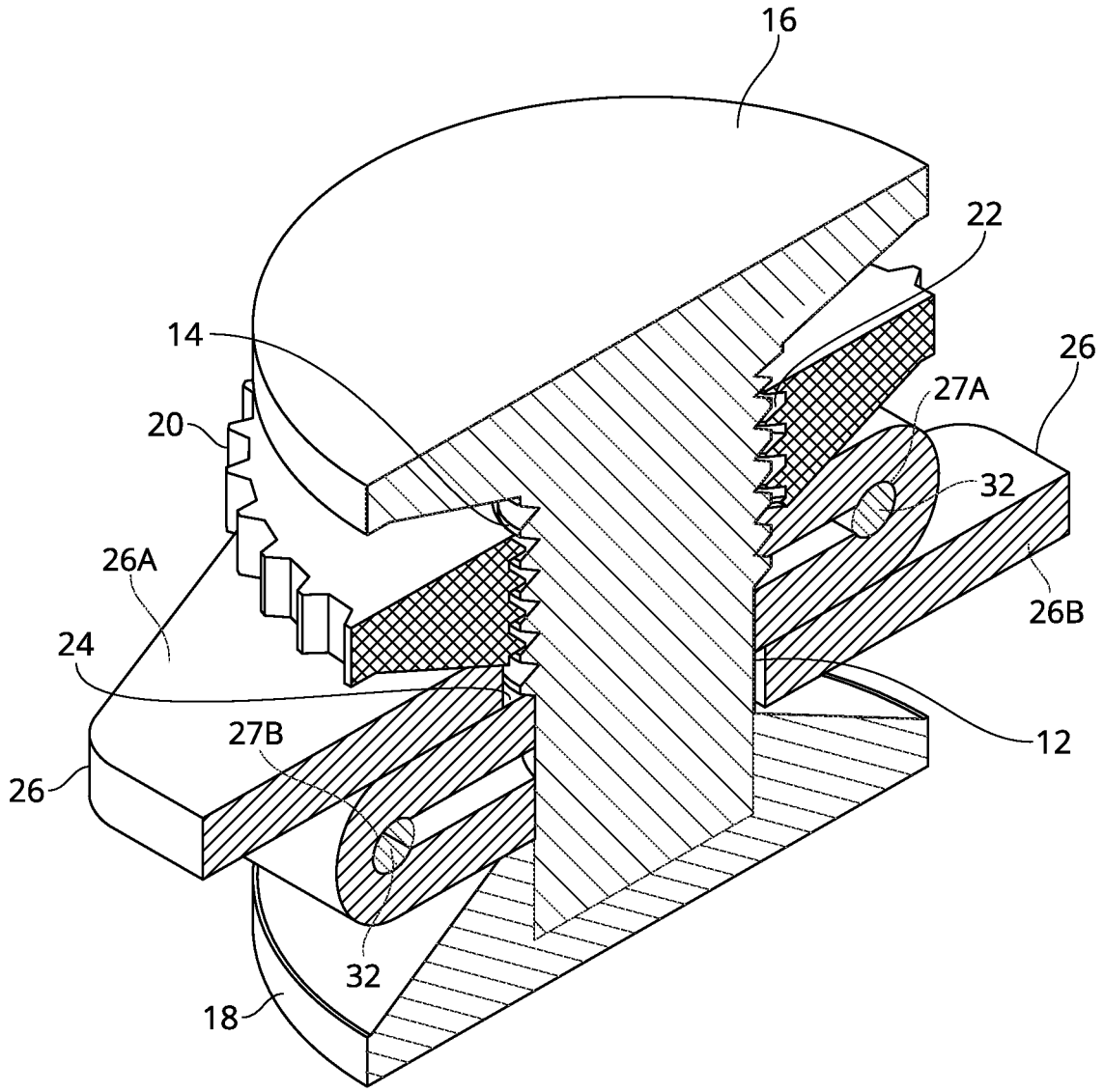
FIG. 6 is a section view similar to FIG. 5, showing increased tension on the tennis racket by the dampener device.

According to various embodiments, as depicted in FIGS. 1-6, dampener device 10 may generally comprise a dampening member 24 and a holder assembly 11 configured to attach dampening member 24 to the strings 32 of tennis racket 30 and to allow for adjustment of the tension imposed by dampening member 24 on racket strings 30.

In certain embodiments, holder assembly 11 may comprise a top member 10A, a bottom member 10B, and a tension adjustment nut 20. In some embodiments, top member 10A includes a top plate 16 and a post 12 which extends downwards from top plate 16. Post 12 may further include a threaded top portion 14. Bottom member 10B may comprise a bottom plate 18 with central cavity 19 configured to lockably receive the bottom end of post 12 (e.g., via a friction fit connection). In certain embodiments, post 12 and bottom plate may be bonded with adhesive. Tension adjustment nut 20 includes a threaded slot 22 configured to threadably engage threaded top portion 14 of post 12. In some embodiments, tension adjustment nut 20 may have a frustoconical bottom profile as shown in the figures. In other embodiments, tension adjustment nut 20 may have a flat bottom profile. It shall be appreciated however that various designs may be employed in alternate embodiments.

In certain embodiments, dampening member 24 may comprise a bendable body 24A made of a material effective in absorbing shock energy. In some embodiments, dampening member 24/bendable body 24A may be essentially flat or planar, as shown in the figures. In certain embodiments, the material of dampening member 24/bendable body 24A may further be stretchable. In one embodiment, dampening member 24 may be made of a thin silicone sheet. However, other shock absorbing/energy dampening materials or combination of materials may be used in alternate embodiments. In some embodiments, dampening member 24 may comprise a central section 25 including a center hole 27, and a pair of oppositely disposed arms 26 (also referred to as "first arm 26A", and "second arm 26B") extending from central section 25. In further embodiments, each arm includes an eyelet or arm hole 28. In some embodiments, arms 26 and arm holes 28 may be symmetrically disposed about central section 25 and/or center hole 27.

In use, first arm 26A may be folded above central section 25 to capture a segment of a first racket string within a top slot 27A formed in the fold juncture between central section 25 and first arm 26A. Second arm 26B may be folded underneath central section 25 to capture a segment of a second racket string within a bottom slot 27B formed in the fold juncture between central section 25 and second arm 26A, the second racket string being adjacent to the first racket string. In folding first and second arms 26A, 26B, both arm holes 28 and center hole 27 are vertically aligned to provide a common hollow for receiving post 12. In some embodiments, the first and second arms may need to be stretched to achieve this alignment. Thus, post 12, with tension adjustment nut 20 engaged through threaded top portion 14, may be passed through the common hollow of folded dampening member 24, first through hole 28 in first arm 26A, then through center hole 27, and lastly through hole 28 in second arm 26B. Bottom member 10B may then be connected to post 12 at the bottom end of the post. This captures dampening member 24 between the tension adjustment nut 20 and bottom plate 18 of holder assembly 11, wherein a dampening and/or twist force is imposed on the adjacent racket strings captured within top and bottom slots 27A and 27B, respectively. As tension adjustment nut 20 is threadably engaged to post 12 it may be twisted in a first rotational direction to move it vertically down and increase pressure against dampening member 24; or in a second rotational direction opposite the first to reduce or loosen the pressure against the dampening member. In this manner, the user may adjust the tension against racket strings 32. According to an exemplary embodiment, device 10 may be installed below the last cross string adjacent the racket handle, but is not limited to this option.

Thus, the disclosed subject matter provides a vibration dampening device with which allows a user to increase or decrease the level of dampening once the device is installed to the racket by tightening or loosening the tension adjustment nut. It shall be appreciated that the disclosed device and system can have multiple configurations in different embodiments. For example, in certain alternate embodiments, tension adjustment nut 20 may be located adjacent bottom plate 18, with threaded portion 14 located at a bottom section of post 12. It shall be appreciated that device 10 may be used with various types of stringed rackets besides and is not limited to tennis rackets only. It shall be appreciated that the device and system described herein may comprise any alternative known materials in the field and be of any color, size, and/or dimensions. It shall be appreciated that the device may be manufactured and assembled using any known techniques in the field.

It shall be understood that the orientation or positional relationship indicated by terms such as "upper", "lower", "front", "rear", "left", "right", "top", "bottom", "inside", "outside" is based on the orientation or positional relationship shown in the accompanying drawings, which is only for convenience and simplification of describing the disclosed subject matter, rather than indicating or implying that the indicated device or element must have a specific orientation or are constructed and operated in a specific orientation, and therefore should not be construed as a limitation of the present invention.

As used herein, the articles "a" and "an" are intended to include one or more items, and may be used interchangeably with "one or more." Where only one item is intended, the term "one" or similar language is used. Also, as used herein, the terms "has", "have", "having", "with" or the like are intended to be open-ended terms. Further, the phrase "based on" is intended to mean "based, at least in part, on" unless explicitly stated otherwise.

The constituent elements of the disclosed device and system listed herein are intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device. Terms such as 'approximate,' 'approximately,' 'about,' etc., as used herein indicate a deviation of within +/−10%. Relationships between the various elements of the disclosed device as described herein are presented as illustrative examples only, and not intended to limit the scope or nature of the relationships between the various elements. Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A vibration dampener device configured to install to the stings of a racket for dampening a vibration energy of the strings, the device comprising:

a dampening member configured to capture a first string segment and a second string segment of the racket; and a holder assembly comprising a post including post threading, a tension adjustment nut threadably engaged to the post threading, and at least one plate, wherein the holder assembly is configured to attach the dampening member to the strings of the racket by sandwiching the dampening member between the tension adjustment nut and the plate, wherein pressure imposed on the dampening member by the holder assembly is adjustable by twisting the tension adjustment nut to move the tension adjustment nut vertically with respect to the post, whereby twisting the tension adjustment nut in a first rotational direction moves it against the dampening member to increase dampening on the strings, and twisting the tension adjustment nut in a second rotational direction opposite the first rotational moves it away from the dampening member to decrease dampening on the strings.

2. The vibration dampener device of claim 1, wherein the dampening member comprises:

a bendable body including a central section and a central hole in the central section;

a first arm extending from a first side of the central section and including a first arm hole; and a second arm extending from a second side of the central section opposite the first side, and including a second arm hole, wherein the dampening member is configured to capture the first string by folding of the first arm over a first surface of the central section to capture the first string in a fold juncture between the central section and the first arm, wherein the dampening member is configured to capture the second string by folding of the second arm over a second surface of the central section opposite the first surface, to capture the first string in a fold juncture between the central section and the first arm, wherein sandwiching the dampening member between the tension adjustment nut and the plate comprises passing the post through the first arm hole, the central hole, and the second arm hole, said first arm hole, central hole, and second arm hole being vertically aligned when the first arm and the second arm are folded over the first surface and the second surface of the central section, respectively.

3. The vibration dampener device of claim 2, wherein the first arm, the second arm, the first arm hole and the second arm hole are symmetrically disposed about the central section.

4. The vibration dampener device of claim 3, wherein the dampening member is substantially flat.

5. The vibration dampener device of claim 4, wherein the dampening member is made of a silicone material.

6. The vibration dampener device of claim 2, the holder assembly comprises a first plate and a second plate, wherein the post extends from the first plate, wherein the second plate is configured to connect to the post at an end of the post opposite the first plate, and wherein the holder assembly is configured to sandwich the dampening member between the tension adjustment nut and the second plate.

7. The vibration dampener device of claim 6, wherein a portion of the post adjacent the first plate is threaded.

8. The vibration dampener device of claim 1, wherein the tension adjustment nut has a frustoconical profile on a side adjacent the dampening member.

9. The vibration dampener device of claim 1, wherein the tension adjustment nut has a flat profile on a side adjacent the dampening member.

10. The vibration dampener device of claim 1, wherein the racket is a tennis racket.

* * * * *